US006094637A

United States Patent [19]

Hong

[11] Patent Number: 6,094,637

[45] Date of Patent: Jul. 25, 2000

[54] FAST MPEG AUDIO SUBBAND DECODING USING A MULTIMEDIA PROCESSOR

[75] Inventor: Kicheon Hong, Seongnam, Rep. of Korea

[73] Assignee: Samsung Electronics Co., Ltd., Kyungki-do, Rep. of Korea

[21] Appl. No.: 08/982,871

[22] Filed: Dec. 2, 1997

[51] Int. Cl.[7] ..... G10L 19/00

[52] U.S. Cl. ..... 704/500; 712/222; 712/2; 708/303; 708/322

[58] Field of Search ..... 712/2, 3, 4, 5, 712/6, 7, 8, 9, 222, 221; 708/301, 303, 315, 319, 320, 322; 704/203, 212, 500–504

[56] References Cited

U.S. PATENT DOCUMENTS

| | | | |
|---|---|---|---|
| 5,644,310 | 7/1997 | Laczko, Sr. et al. | 341/143 |
| 5,864,703 | 6/1999 | Van Hook et al. | 712/22 |
| 5,931,892 | 8/1999 | Thome et al. | 708/322 |
| 5,933,650 | 8/1999 | Van Hook et al. | 712/2 |

OTHER PUBLICATIONS

Bhaskaran et al., Algorithmic and Architectural Enhancements for Real–time MPEG–1 decoding on a general purpouse RISC workstation. IEEE Transactions on circuits and systems for video technology, vol. 5, Jan. 1995.

Tsai et al., An MPEG Audio decoder chip, IEEE Transactions on Consumer Electronics, vol. 41, No. 1. pp. 89–96, Feb. 1995.

Tsai et al., Design and VLSI implementaion of MPEG Audio decoder, pp. 206–210, Feb. 1995.

Murphy et al., Real–time MPEG–1 Audio coding and Decoding on a DSP Chip, IEEE Transaction on Consumer Electronics, vol. 43, No. 1, pp. 40–47, Feb. 1997.

Tasi et al., A Novel MPEG–2 Audio Decoder with efficient data arrangement and memory configuration, pp. 1–7, Jun. 1997.

*Primary Examiner*—David R. Hudspeth
*Assistant Examiner*—Abul K. Azad
*Attorney, Agent, or Firm*—Skjerven, Morrill, MacPherson, Franklin & Friel LLP; David T. Millers

[57] ABSTRACT

A decoding process for a MPEG1 audio subband uses the symmetry of filter coefficients to reduce the number of multiplications required to decode an audio subband. The decoding process can be efficiently implemented on a single-instruction-multiple-data (SIMD) processor having vector registers capable of holding multiple samples from the subband. In a particular embodiment, some of samples are stored in a first vector register in a normal order and other samples are stored in a second vector register in a reverse order. For example, for eight data element vector registers, the first vector register contains a series of samples index values 0 to 7, and the second vector register contains a series of samples index values 31 to 24. Such ordering facilitates SIMD instructions which perform parallel operations combining value of index i with values of index 31–i. In accordance with another aspect of the invention, time domain samples having odd and even time indices are determined in parallel using vectors having data elements with indices corresponding to the time indices and a sign vector where each data element of the sign vector is positive or negative according to whether the associated time index is even or odd.

12 Claims, 4 Drawing Sheets

FAST MPEG AUDIO SUBBAND DECODING USING A MULTIMEDIA PROCESSOR

BACKGROUND

1. Field of the Invention

This invention relates to systems and methods for decoding a digital audio signal in compliance with the MPEG standard.

2. Description of Related Art

The MPEG1 and MPEG2 standards are well known for digital encoding and decoding of video and audio. The MPEG standards represent images and sounds as digital data which includes video data and audio data. The digital data can be stored in memory or on a permanent media such as a CDROM or transmitted to a receiver for real-time decoding and performance. Audio data in an MPEG compatible data stream is commonly referred to as the audio subband. In accordance with the MPEG standards, the audio subband contains sets of 32 code values which are frequency domain samples Sk. Decoding 32 frequency domain samples Sk, where k is a frequency index and ranges from 0 to 31, generates 64 time domain sound samples Vi, where i is a time index and ranges from 0 to 63.

Table 1 contains a "C" code listing of an audio subband decoding process in compliance with the MPEG1 standard.

TABLE 1

Subband Decoding Process

```
for(i=0; i<64; i++)
{    V[i]=0;
     for(k=0; k<32; k++)
          V[i] += (N[i][k]*S[k]); /* Multiply-and-Accumulate */
};
```

In Table 1, N[i][k] are the subband synthesis filter coefficients Nik defined by the MPEG 1 standard. In accordance with the process of Table 1, calculation of each time domain audio sample V[i] requires 32 multiply-and-accumulate operations, and decoding of a 32-element subband requires 64*32 or 2048 multiply-and-accumulate operations. This is a significant calculational burden especially for real time decoding where time domain samples are required at frequencies of up to 48 kHz.

A variety of systems have been developed to perform real-time MPEG decoding. One type of system uses a general-purpose microprocessor that executes the process of Table 1 to decode subband data for audio and executes a video decoding process for video. A general purpose processor generally requires a high clock speed for real time MPEG decoding since general-purpose processors often do not contain execution units specialized for such decoding. Another type of system uses a special-purpose MPEG decoder or signal processor implemented specifically for MPEG audio and/or video decoding. Such specialized hardware has limited application to tasks other MPEG decoding. Alternatively, multimedia processors have recently been proposed that are suited for a wide variety of multimedia applications including but not limited to decoding compressed video and audio data. U.S. patent application Ser. No. 08/699,597, filed Aug. 19, 1996, entitled "Single-Instruction-Multiple-Data Processor in a Multimedia Signal Processor" describes an exemplary multimedia processor and is incorporated by reference herein in its entirety.

The exemplary multimedia processor includes two subprocessors. One subprocessor, referred to as the scalar processor, is specially designed for execution of scalar operations such as indexing and conditional operations. The other subprocessor, referred to as the vector processor, supports vector arithmetic operations where execution of a single instruction causes the vector processor to perform multiple parallel operations on a set of data elements that form a data vector. Performing the same operation on multiple data elements in parallel is desirable for multimedia applications which often require performing the same operation for each data element in a large set of data elements. Methods for using a vector processor to quickly and efficiently execute multimedia processes such as the decoding of subband information are sought.

SUMMARY

In accordance with the invention, a subband decoding process relies on symmetry in the subband synthesis filter coefficients to reduce the number of operations required for decoding an audio subband in compliance with the MPEG1 standard. The process further arranges the reduced number of operations for fast and efficient execution by a single-instruction-multiple-data (SIMD) processor. Such execution is facilitated by a vector processor instruction that reverses the order of data elements in a vector register or loads data elements in a vector register in an order that is reversed from the order in which the data elements are stored in memory.

In accordance with an embodiment of the invention, a method for decoding a sequence of code values, includes: ordering first code values from the sequence, in a first vector register of a processor so that the first code values have an order defined by the sequence; ordering second code values from the sequence, in a second vector register of the processor so that the second code values have an order reversed from that defined by the sequence; and ordering filter coefficients in a third vector register of the processor so that each filter coefficient associated with a code value in the first set is at a relative position in the third vector register that is the same as a relative position of the associated code value in the first vector register. With this ordering, a program can combine code values from the first and second sets and the filter coefficients which are at the same relative positions in respective first, second, and third vector registers. In particular, a parallel add or subtract operation can add or subtract the first vector register which contains code values having index i in some range to or from the second vector register which contains code values having index 31−i. The a register containing resulting sums or differences of the code values from the first and second vector registers and can then be multiplied by the filter coefficients in the third vector register. The resulting products are then accumulated. Such decoding methods are fast and efficient for decoding of MPEG audio subbands.

An alternative process in accordance with the invention uses an SIMD processor to decode in parallel multiple time domain sound values. For the alternative process, a vector register (or set of vector registers) contains filter coefficients corresponding to different time domain samples to be decoded from code values. All data elements in this vector register are multiplied in parallel by the same code value and the resulting products are added to or subtracted from accumulated values in a vector register or accumulator. The multiplication and accumulation is repeated for each code value that contributes to the time domain samples being decoded (e.g., up to 32 times for MPEG subband decoding.) For MPEG decoding, each accumulation either adds all of the data elements of the resulting product to the accumulated values or adds and subtracts some of the elements. Multiplication by a sign vector, which contains elements that are positive (e.g., +1) or negative (e.g., −1), converts some of the product elements to their additive inverse. Accordingly, accumulation of products can be accomplished in parallel through a vector addition instruction rather than handling each data element separately according to whether accumulation for the associated time index requires addition or subtraction of that data element. The process requires fewer control operations, which can be inefficient to implement in an SIMD processor, to select between addition and subtraction.

Optionally, the alternative process initializes the SIMD processor by storing a first set of code values, e.g., frequency samples, in a normal sequential order in a first vector register (or set of vector registers), a second set of the code values in reverse order in a second vector register (or set of vector registers). With this ordering, the same index value selects a first code value from the first vector register and a second code value from the second vector register where determination of time domain samples multiplies the first and second code values by the same filter coefficients. Alternatively all of the code values are loaded in the same order.

DETAILED DESCRIPTION OF THE PREFERRED EMBODIMENTS

Figure 1:
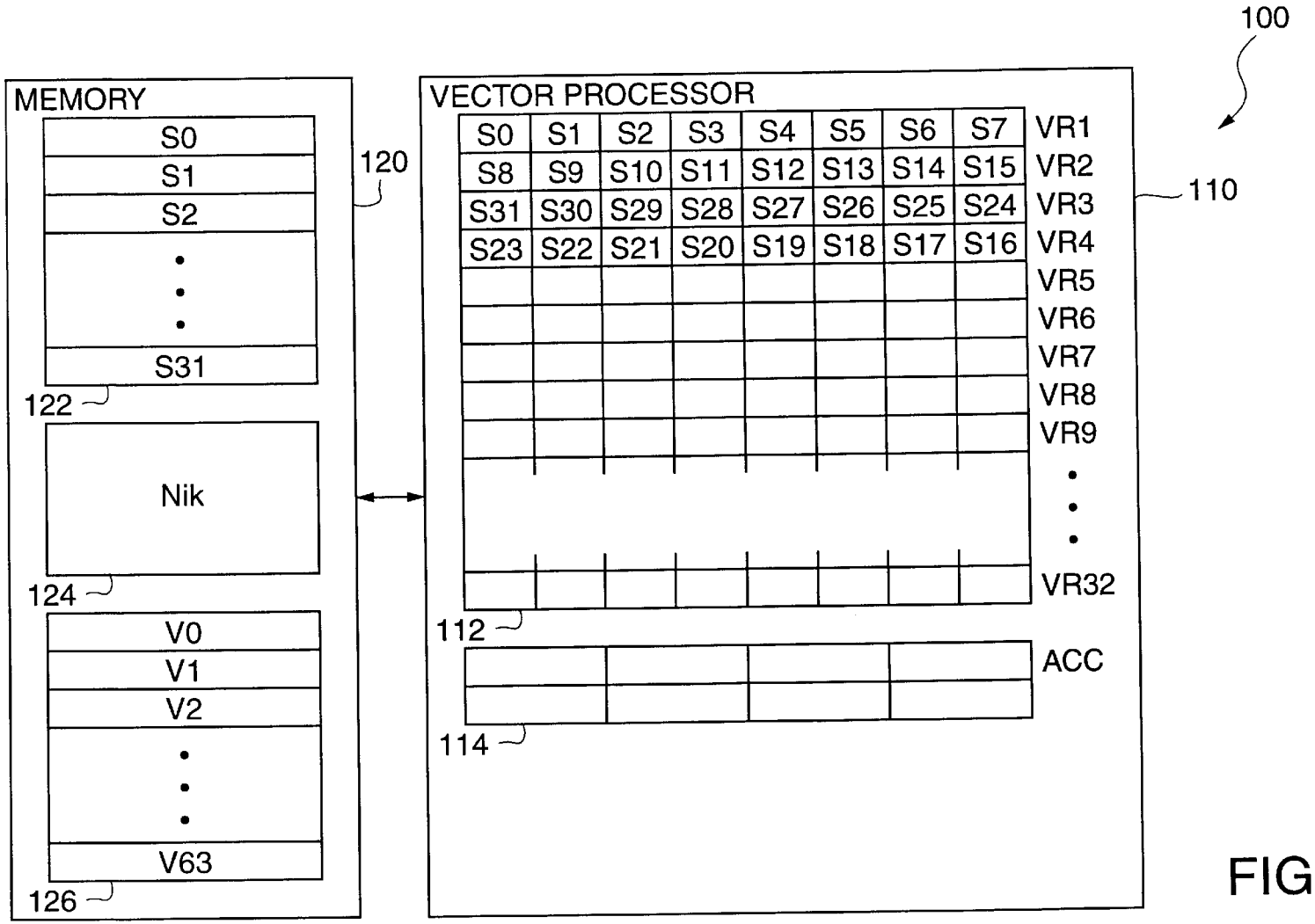
FIG. 1 is a block diagram of a single-instruction-multiple-data processing system for execution of the processes of FIGS. 2, 3, and 4.

In accordance with the MPEG1 standard, a time domain sound sample Vi is equal to a summation of products of frequency domain samples (or code values) Sk and filter coefficients Nik as indicated in Equation 1.

Equation 1:

$$V_i = \sum_{k=0}^{31} N_{ik} * S_k$$

The standard MPEG1 subband decoding process in Table 1 requires 32 multiply-and-accumulate operations per time domain sample Vi to perform the summation of Equation 1, and requires 2048 multiply-and-accumulate operations to determine 64 time domain sound samples Vi, where time index i ranges from 0 to 63. In accordance with an aspect of the invention, symmetry and/or periodicity in filter coefficients Nik reduces the number of operations required for determining the summations of Equation 1.

MPEG1 defines filter coefficients Nik in terms of a cosine function as given in Equation 2.

$$Nik=\cos\{[(16+i)(2k+1)]\cdot 2\pi/128\} \qquad \text{Equation 2:}$$

For a fixed value of time index i, the periodic nature of the cosine creates relationships between filter coefficients for different values of frequency index k. For example, Equation 3 indicates the relationship between filter coefficients Nik and Nik' when an index k is equal to 32−(k'+1).

$$Nik=(-1)^i\cdot Nik' \text{ when } k=31-k' \qquad \text{Equation 3:}$$

Using the relationship of Equation 3 in Equation 1 yields Equation 4.

Equation 4:

$$V_i = \sum_{k=0}^{15} \{N_{ik}\cdot(S_k + (-1)^i\cdot S_{31-k})\}$$

Determination of Vi using Equation 4 requires fewer multiplications of filter coefficients when determining a time domain sample Vi. If index i is an even number, each of the 15 terms in the summation of Equation 4 is a product of a filter coefficient Nik and a sum of two frequency domain samples Sk and S[31−k]. If index i is odd, each term is a product of a filter coefficient Nik and a difference between two frequency domain coefficients Sk and S[31−k].

The symmetry of the filter coefficients Nik also indicates that not all 64 time domain samples Vi need to be determined from the summation of Equation 1 or 4. In particular, if index i is equal to 32−i' then the filter coefficient Nik is the negative of filter coefficient Ni'k.

$$Nik=-Ni'k \text{ when } i=32-i' \qquad \text{Equation 5:}$$

If index i is equal to 96−i', filter coefficient Nik is equal to filter coefficient Ni'k.

$$Nik=Ni'k \text{ when } i=96-i' \qquad \text{Equation 6:}$$

As a consequence of Equations 4 and 5, the time domain samples Vi for index i between 0 and 32 are related as indicated in Equation 7.

$$Vi=-V[32-i] \text{ when } 0\leqq i\leqq 32 \qquad \text{Equation 7:}$$

Equation 7 requires that V16 be zero. As a consequence of Equations 4 and 6, the time domain samples Vi for index i between 33 and 48 are related to the time domain samples Vi for index i between 48 and 63 as indicated in Equation 8.

$$Vi=V[96-i] \text{ when } 48\leqq i\leqq 63 \qquad \text{Equation 8:}$$

Accordingly, only 32 time domains samples in a selected set including V0 to V15 or V17 to V32, V48, and V33 to V47 or V49 to V63 need to be calculated from a summation such as in Equation 1 or 4. The time domain samples not in the selected set are zero (for V16) or can be determined from Equation 7 or 8 and a time domain sample in the selected set.

In accordance with an aspect of the invention, a decoding process uses the relationships defined in Equations 4, 7, and 8 to reduce by a factor of four (i.e., from 2048 to 512) the number of required multiplications by filter coefficients Nik. Using a vector processor further reduces the number of multiplication instructions executed because each multiplication instruction executed completes multiple multiplication operations. A vector processor such as described in U.S. patent application Ser. No. 08/699,597 which was incorporated by reference herein above can efficiently conduct such subband decoding. FIG. 1 shows a system 100 capable of executing an audio decoding process in accordance with an embodiment of the invention. System 100 includes a processor 110 which is coupled to a main memory 120. Processor 110 is sometime referred to herein as a vector processor and has a single-instruction-multiple-data (SIMD) architecture that allows processor 110 to process multiple data elements simultaneously. In the embodiment illustrated in FIG. 1, processor 110 includes a set of vector registers 112, for example, a bank of 32 vector registers where each vector register is capable of storing eight 16-bit data elements such integer sound samples Sk. Processor 110 executes instructions which process data elements of one or more vector registers in parallel. An accumulator 114 in processor 110 is a special double-precision vector register capable of storing eight 32-bit data elements.

Memory 120 initially contains filter coefficients 124 and an audio subband 122 for decoding. Not all filter coefficients Nik defined by the MPEG1 standard are required in memory 120. In particular, filter coefficients Nik for index i between 17 and 48 and index k between 0 and 15 are sufficient for decoding subband 122. Audio subband 122 contains 32 sound samples stored in memory 120 in order of increasing frequency index k. Space 126 in memory 120 is for time domain samples V0 to V63 that decoding generates. Sample V16 is always zero and can be preset to zero in memory 120.

Figure 2:
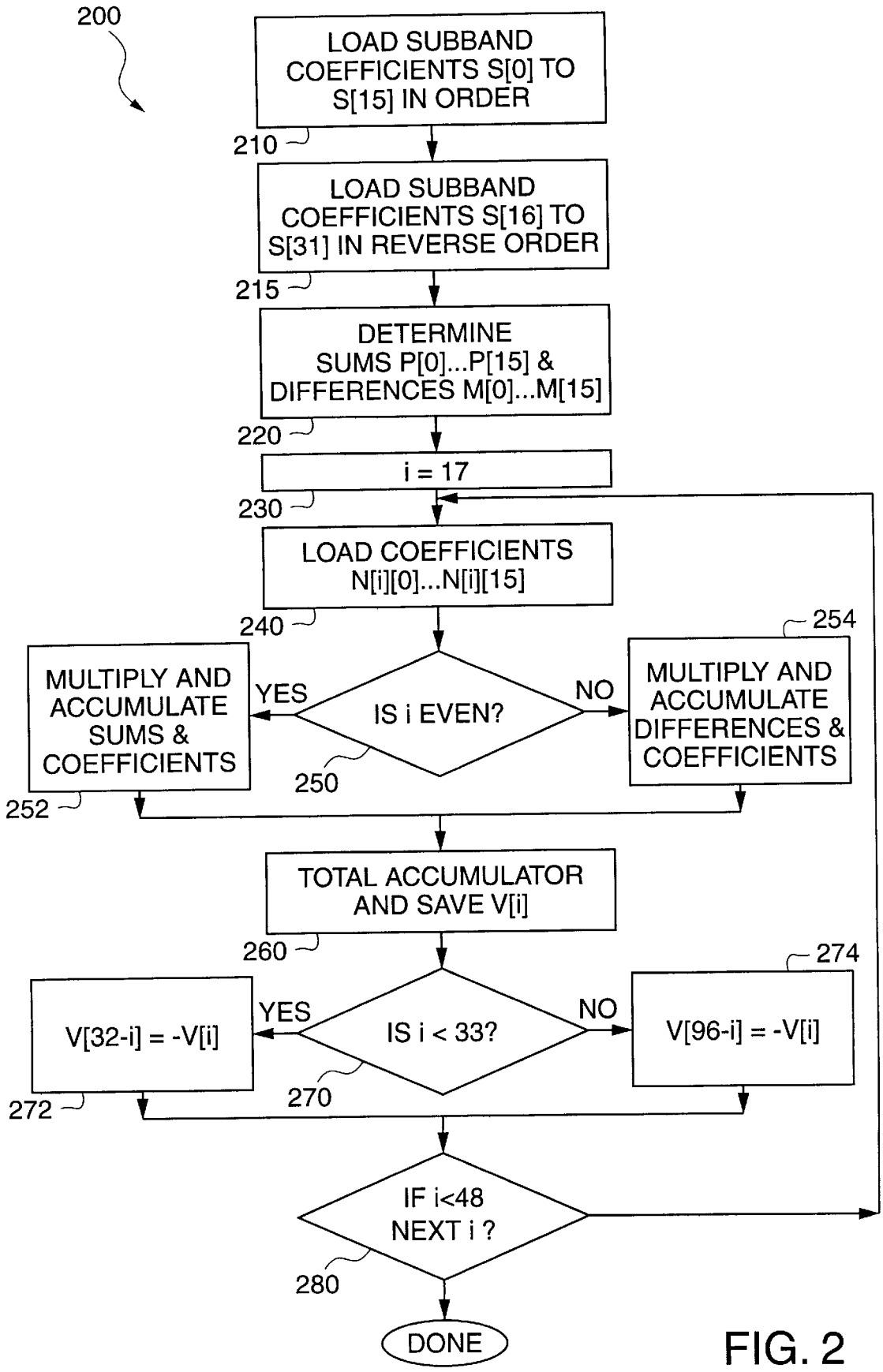
FIG. 2 is a flow diagram of an MPEG audio subband decoding process that decodes one time domain sound sample in series in accordance with an embodiment of the invention.

A decoding process 200 illustrated in FIG. 2 begins in a step 210 with loading subband coefficients S0 to S15 in order, in vector registers of processor 110. Conventional load operations or instructions load sixteen 16-bit data elements in order into vector registers VR1 and VR2 of the exemplary processor. A step 215 loads and orders samples S16 to S31 in processor 110 so that by the end of step 215, samples S16 to S31 are in vector registers VR3 and VR4 in an order that is opposite the order of samples S0 to S15. The exemplary processor 110 implements an instruction (VLR) which loads eight data elements into a vector register in an order that is the reverse of the order of the data elements in memory. Two VLR instructions can load samples S16 to S31 into vector registers VR3 and VR4. Alternatively, data elements are loaded into vector registers in the memory order and then reordered within the vector registers. Reversing the order of samples S16 to S31 simplifies the calculations of summations as in Equation 4 where sample S[31−k] is added to or subtracted from sample Sk. Step 220 calculates sums P0 to P15 which are equal to Sk+S[31−k] for k from 0 to 15 for uses when time index i is even and differences M0 to M15 which are equal to Sk-S[31−k] for k from 0 to 15 for uses when time index i is odd. In the exemplary embodiment, processor 110 performs step 220 by executing four instructions, a vector addition of vector registers VR1 and VR3, a vector addition of VR2 and VR4, a vector subtraction of vector register VR3 from VR1, and a vector subtraction of VR4 from VR2. Sums P0 to P15 are stored in vector registers VR5 and VR6. Differences M0 to M15 are stored in vector registers VR7 and VR8. In accordance with Equation 4, sums P0 to P15 are for calculation of samples Vi with time index i being even, and differences M0 to M15 are for calculation of samples Vi with time index i being odd.

A step 230 initializes index i to 17 for a loop that will calculate samples V17 to V48. Samples V17 to V48 indicate the magnitudes of all samples V0 to V63. As indicated above, alternative subsets of samples V0 to V63 can be selected for calculation. For the other selections, the range of index i is correspondingly changed. Step 240 loads sixteen filter coefficients Ni0 to N[i][15] for the current value of index i. Filter coefficients Ni0 to N[i][15] are all associated and used to calculate a single time domain sample. Step 250 determines whether index i is even or odd. If index i is even, step 252 is performed. For step 252 in the exemplary embodiment, processor 110 clears accumulator 114 and executes two vector multiply-and-accumulate (VMAC) instructions on sums P0 to P15 and filter coefficients Ni0 to Ni15. The first VMAC instruction performs eight multiplications (V0*Ni0 to V7*Ni7) and leaves eight products in accumulator 114. The second VMAC instruction performs eight multiplications (V8*Ni8 to V15*Ni15) and adds eight products to the eight products already in accumulator 114. Similarly, if index i is odd, processor 110 performs step 254 by clearing accumulator 114 and executing two vector VMAC instructions on differences M0 to M15 and filter coefficients Ni0 to N[i][15]. The first VMAC instruction performs eight multiplications (M0*Ni0 to M7*Ni7) and leaves eight products in accumulator 114. The second VMAC adds eight products (M8*Ni8 to M15*Ni15) to the eight products in accumulator 114.

The eight partial sums in accumulator 114 must be added together to generate a sample Vi. (The VMAC instructions perform eight of the sixteen additions required for the summation of Equation 4.) Step 260 adds the data elements of accumulator 114 together and saves the result in section 126 of memory 120. Addition of the data elements in accumulator 114 may be performed by seven scalar additions. Alternatively, the exemplary embodiment of processor 110 implements an instruction (VADDH) that performs eight parallel adds of adjacent data elements in a vector register. With this vector addition followed by an instruction (VUNSHFLL) to reorder data elements in the vector register, processor 110 can total eight elements by executing five instructions (three VADDH instructions and two VUNSHFLL instructions). The resultant sample Vi is stored at the appropriate location in memory 120.

After step 260 determines sample Vi, step 270 determines whether index i is less than 33. If index i is less than 33, Equation 7 applies, and step 272 stores the negative of the determined sample Vi in memory 120 as the value of sample V[31−i]. If index i is not less than 33, Equation 8 applies, and step 274 stores the determined value Vi in memory 120 as the value of sample V[96−i]. Following step 272 or 274, step 280 increments index i and if i is not greater than 48, branches back to step 240 to load coefficients Nik for the new value of index i. A loop including steps between step 240 and step 280 is repeated 32 times after which all 64 time domain samples V0 to V63 are ready.

As a variation on process 200, calculation of sums P0 to P15 and differences M0 to M15 (step 220) can be omitted. If step 220 is omitted, steps 252 and 254 multiply subband coefficients S0 to S31 and filter coefficients Ni0 to Ni15. Samples S16 to S31 have a reversed order when compared to samples S0 to S15 and coefficients Ni0 to Ni15, which is the correct order for vector disadvantage of omitting step 220 is an increase in the number of multiply-and-accumulate operations performed.

Figure 3:
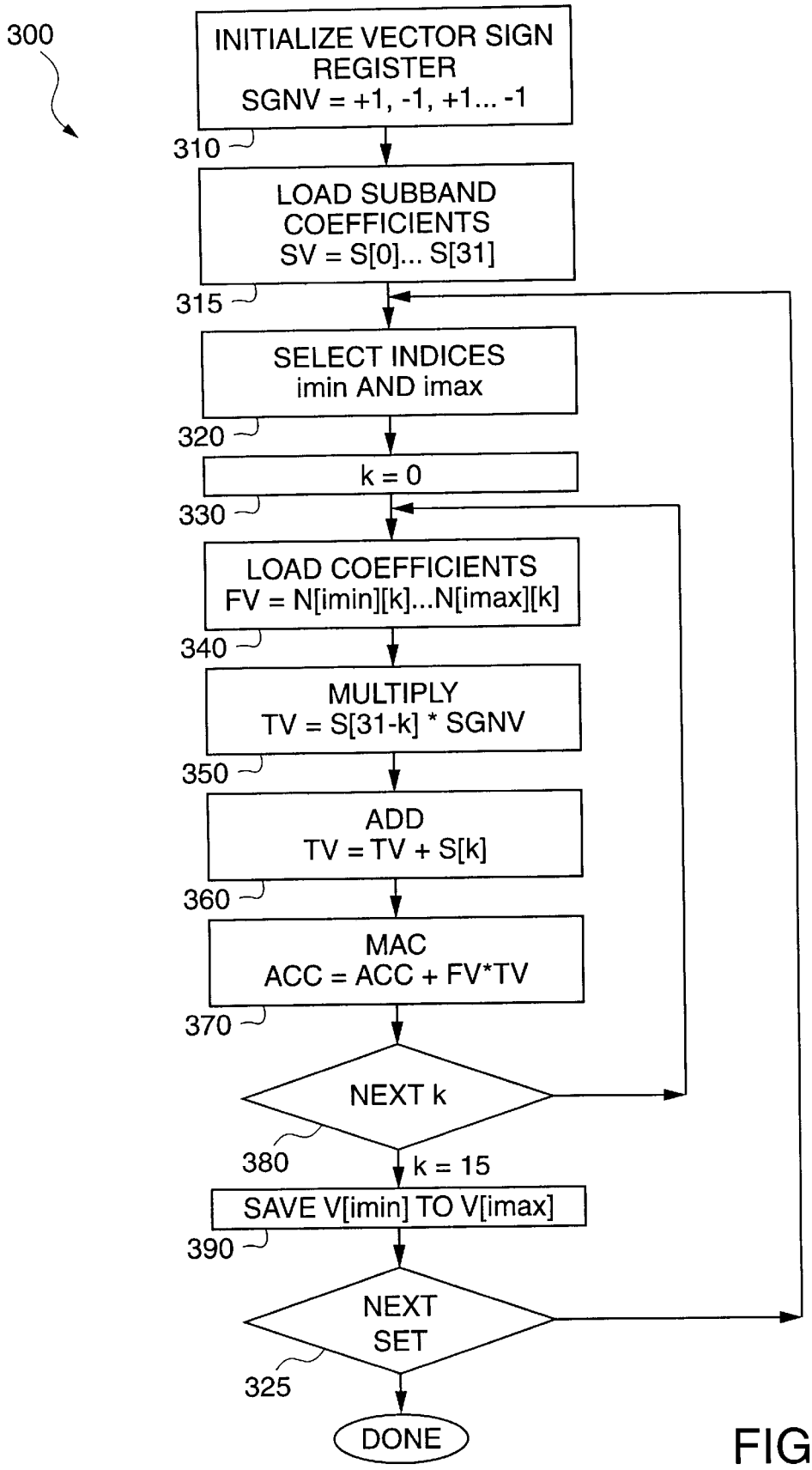
FIGS. 3 and 4 are flow diagrams of MPEG audio subband decoding processes that decode multiple time domain samples in parallel in accordance with other embodiments of the invention.

FIG. 3 illustrates a decoding process 300 in accordance with another embodiment of the invention. Like decoding process 200 of FIG. 2, decoding process 300 is executable by vector processor 100 of FIG. 1, but process 300 differs from process 200 by determining multiple time domain samples Vi in parallel rather than in series. Process 300 begins in steps 310 which initializes a sign vector SGNV with plus and minus ones. For example, vector register VR5 in the exemplary embodiment has eight data elements which can be labeled VR5[n] where a data element index n ranges from 0 to 7. Step 310 stores the value one (+1) in data elements having an even index value and the value minus one (−1) in data elements having an odd index value. The use of the sign vector SGNV is described below.

When an audio subband is ready for decoding, step 315 loads vector registers such as registers VR1 to VR4 with the frequency domain samples Sk from the subband. Samples Sk are stored in the vector processor with samples S0 to S15 in one order and samples S16 to S31 in an opposite order. For example, samples S0 to S15 can be stored in the normal sequential order while samples S16 to S31 are stored in reversed sequential order. Alternatively, frequency samples Sk can be stored in any desired order if samples Sk are used as individual data element rather than as vectors.

Step 320 selects the time indices for a set of time domain samples to be determined in parallel. The number of samples Vi determined at a time depends on the number of data elements per vector register. Processor 100 can determine eight samples Vi in parallel, and for the exemplary embodiment, step 320 selects a range of eight time indices [imin, imax] from 17 to 24 for the samples Vi first calculated. For each selection of time indices in step 320, a loop containing steps 340, 350, 360, 370, and 380 is executed sixteen times, once for each value of frequency index k between 0 and 15 as in Equation 4. Before the loop, step 330 initializes frequency index k. Step 340 loads filter coefficients that correspond to the selected range of time indices and to the current frequency index k, and in particular loads N[imin][k] to N[imax][k] as a filter vector FV having one data element per value of time index i from imin to imax.

Step 350 multiplies sample S[31−k] by sign vector SGNV. This creates a temporary vector TV having elements which are equal to S[31−k] for even data element indices and equal to −S[31−k] for odd data element indices. Step 360 adds sample S[k] to each element of vector TV. In vector TV after step 360, the data elements are equal to either the sum (S[k]+S[31−k]) or the difference (S[k]−S[31−k]). The data element indices of vector TV correspond to the selected time indices. Step 370 multiplies each data element (sum or difference) in vector TV by a corresponding element in filter vector FV and accumulates the results in vector accumulator ACC. In the exemplary embodiment, one execution of steps 350, 360, and 370 calculates and accumulates eight terms, one term of Equation 4 for each of the selected values of the time index. Step 380 causes process 300 to loop through steps 340, 350, 360, and 370 sixteen times as required to calculate eight time domain samples V[imin] to V[imax] using Equation 4.

Steps 350, 360, and 370 can be replaced with a variety of procedures that achieve the same result. For example, instead of multiplying sample S[32−k] by sign vector SGNV, sample S[32−k] can be multiplied by filter vector FV with the result of that multiplication being accumulated in accumulator ACC. For this variation, sample Sk is independently multiplied by filter vector FV and accumulated into accumulator ACC. Other processes for achieving these results will be apparent in view of this disclosure.

Step 390 saves the calculated time domain samples in memory 120. From Equations 7 and 8, the calculated time domain samples indicate two time domain samples which can be stored in two storage locations. Following step 390, if further time domain samples are needed, process 300 returns through a step 325 to step 320 and selects the next set of time domain samples to be calculated. An advantage of process 300 over process 200 is that time domain samples are determined without requiring a vector processor to execute control instructions that select multiplication of filter coefficients by sums or differences depending on whether the time index is even or odd. Implementation and execution of control instructions can be inefficient for a vector processor because such control instructions typically do not utilize the parallel processing capabilities of the vector processor. Process 300 avoid execution of such control operations. However, process 300 requires additional arithmetic operations such as multiplication of samples S[31−k] by sign vector SGNV.

Figure 4:
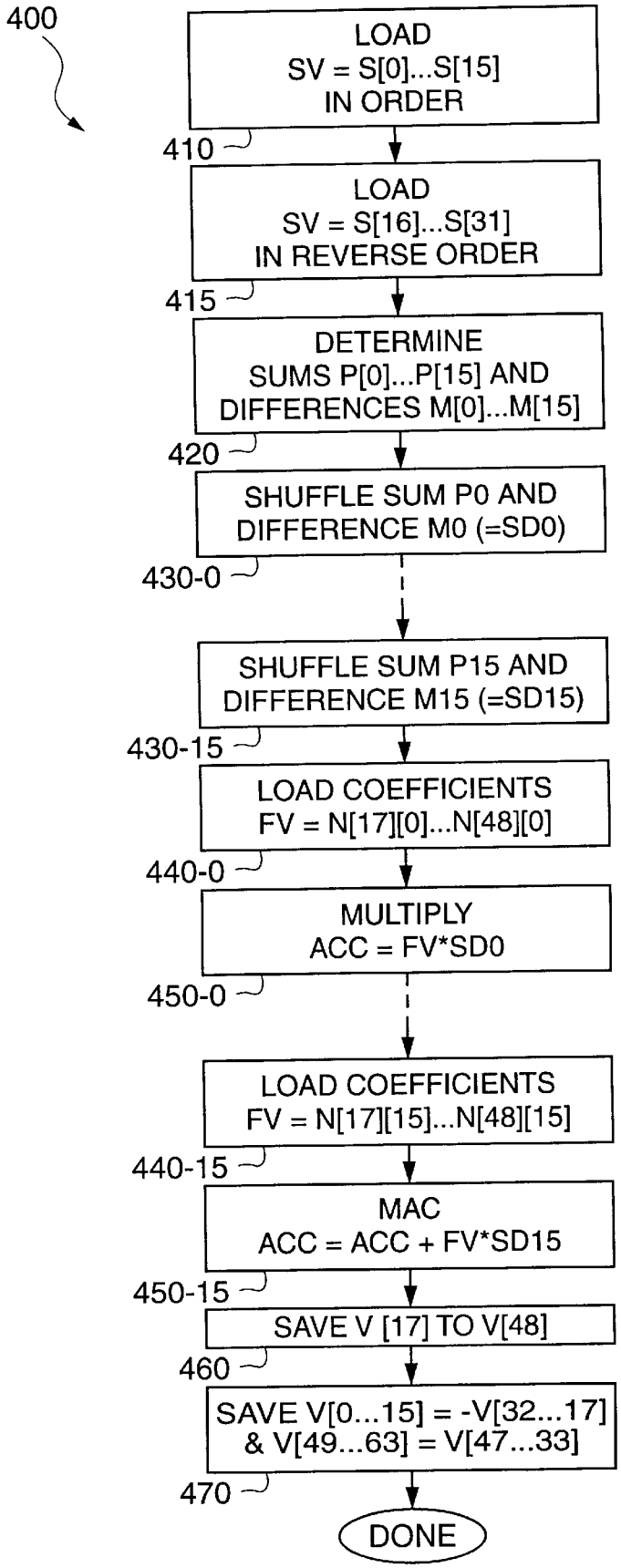

FIG. 4 shows a flow diagram of a process 400 that calculates multiple time domain sound samples Vi in parallel using fewer arithmetic operations than required for process 300 of FIG. 3 and no branches or conditional statements as required in process 300 and process 200 of FIG. 2. Process 400 initially loads subband coefficients S0 to S15 in order (step 410) and loads subband coefficients S16 to S32 in reverse order (step 415) in vector registers. A step 420 then calculates the sums P0 to P15 (where P[k]=S[k]+S[31−k]) and the differences M0 to M15 (where M[k]=S[k]−S[31−k]) of the subband coefficients. The sums and differences can be determined by direct addition or subtraction of normal-ordered and reverse-ordered vector registers. Once the sums and differences are determined, a step 430-0 shuffles into a sum/difference vector SD0 the sum P0 and difference M0. As a result of step 430-0, vector SDO has sum P0 as even numbered data elements and difference M0 as odd numbered data elements. Steps 430-1 (not shown) to 430-15 similarly shuffle sums and differences to construct vectors SD1 to SD15. Each vector SDk (for k=0 to 15) has sum Pk as even numbered data elements and difference Mk as odd numbered data elements. Vectors SD0 to SD15 are kept in the register file of the vector processor, assuming that the register file is sufficiently large to accommodate these vectors.

A step 440-0 loads into a filter vector FV the necessary filter coefficients that are associated with the frequency index k equal to 0. For example, step 440-0 loads coefficients Ni0 for i=17 to 48 into one or more vector registers in order. Step 450-0 multiplies the filter coefficient vector FV by the sum/difference vector SD0 and stores the result in an accumulation vector ACC. Similar pairs of steps 440-1 (not shown) and 450-1 (not shown) to 440-15 and 450-15 load filter coefficients associated with other frequency index values and perform multiply-and-accumulate operations. In particular, step 440-k (for k=1 to 15) loads coefficients Nik for i=17 to 48 into filter vector FV, and step 450-k multiplies filter vector FV by sum/difference vector SDk and accumulates the result into accumulation vector ACC. After step 450-15, time domain samples V17 to V48 are known, and step 460 saves the known samples in memory 120. Time domain samples not directly calculated can be determined from Equations 7 and 8. In particular, step 470 saves the negatives of samples V[32] to V[17] as samples V[0] to V[15], respectively, and saves V[47] to V[33] as samples V[49] to V[63], respectively. (Sample V16 is always zero.)

Process 400 has several advantages when implemented on a vector processor. In particular, process 400 does not require any conditional instructions or branches which may be inefficient to execute on a SIMD processor. Process 400 only needs to perform addition and subtraction for calculation of the sums and differences of subband coefficients once, and several time domains samples Vi can be reconstructed in parallel using the sums and differences. Further, process 400 does not require that the elements in the accumulator be added together (for example, as in step 260 of process 200) because after step 450-15 each element of the accumulator contains an independent sample Vi.

Although the invention has been described with reference to particular embodiments, the description is only an example of the invention's application and should not be taken as a limitation. In particular, even though much of preceding discussion was aimed at an exemplary processor implementing specific instructions, principles of the invention are applicable to processors implementing other instructions sets including parallel manipulation of data elements. Various other adaptations and combinations of features of the embodiments disclosed are within the scope of the invention as defined by the following claims.

I claim:

1. A method for decoding a sequence of code values, comprising:

loading first code values from the sequence, in a first vector register of a processor so that the first code values have an order defined by the sequence;

loading second code values from the sequence, in a second vector register of the processor so that the second code values have an order reversed from that defined by the sequence;

loading filter coefficients in a third vector register of the processor so that each filter coefficient associated with a code value in the first set is at a relative position in the third vector register that is the same as a relative position of the associated code value in the first vector register; and executing a program that decodes a portion of the sequence by combining code values in the first set, code values in the second set, and the filter coefficients which are at the same relative positions in respective first, second, and third vector registers.

2. The method of claim 1, wherein executing the program comprises performing a plurality of arithmetic operations in parallel, wherein each arithmetic operation corresponds to a specific relative position in the first, second, and third vector register.

3. The method of claim 1, wherein the processor is a single-instruction-multiple-data processor.

4. The method of claim 1, wherein the sequence of code values is an MPEG compliant audio subband.

5. The method of claim 1, wherein executing the program comprises executing an instruction that multiplies each code value in the second set by a filter coefficient that is in the same relative position in the third register as the code value is in the second register.

6. The method of claim 1, wherein executing the program comprises executing an instruction that adds each code value in the second set with a code value in the first register in the same relative position as the code value is in the second register.

7. A method for decoding a sequence of code values, comprising:

loading positive and negative values as data elements in a first vector register of a processor;

multiplying each of the data elements by a first code value from the sequence to generate a first vector containing data elements that are products resulting from the multiplying;

adding a second code value from the sequence to each of the data elements of the first vector to generate a second vector containing data elements that are sums resulting from the adding;

accumulating products of the data elements of the second vector and corresponding data elements of a second vector register of the processor containing filter coefficients, wherein accumulating generates a fourth vector having data elements that are accumulations; and repeating the multiplying, adding, and accumulating steps until each code value in the sequence has contributed to the accumulations as required for decoding a portion of the code.

8. The method of claim 7, further comprising:

loading first code values from the sequence, in a third vector register of the processor so that the first code values have an order reversed from that defined by the sequence;

loading second code values from the sequence, in a fourth vector register of the processor so that the second code values have an order defined by the sequence; and selecting the second code value for each adding step using an index, wherein the index defines a data element that is in the fourth vector register and contains the second code value and defines a data element that is in the third vector register and contains the first code value for a preceding multiplying step.

9. The method of claim 7, wherein after the loading step, each data element of the first vector register contains a negative value if a data element index for the data element is odd and contains a positive value if the data element index for the data element is even.

10. The method of claim 7, wherein each positive value is equal to 1 and each negative value is equal to −1.

11. The method of claim 7, wherein the code values are frequency samples from an audio subband in compliance with an MPEG standard.

12. The method of claim 7, wherein each step of adding, multiplying, and accumulating operates on data elements in parallel.

* * * * *